US011831066B2

(12) United States Patent
Bae

(10) Patent No.: US 11,831,066 B2
(45) Date of Patent: Nov. 28, 2023

(54) VEHICLE AND ANTENNA SYSTEM OF VEHICLE

(71) Applicants: Hyundai Motor Company, Seoul (KR); Kia Motors Corporation, Seoul (KR)

(72) Inventor: Jungnam Bae, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 215 days.

(21) Appl. No.: 16/846,815

(22) Filed: Apr. 13, 2020

(65) Prior Publication Data

US 2021/0194110 A1 Jun. 24, 2021

(30) Foreign Application Priority Data

Dec. 20, 2019 (KR) ..... 10-2019-0171644

(51) Int. Cl.
*H01Q 1/32* (2006.01)
*H01Q 1/12* (2006.01)
*H01Q 7/00* (2006.01)

(52) U.S. Cl.
CPC ..... *H01Q 1/1271* (2013.01); *H01Q 1/3291* (2013.01); *H01Q 7/00* (2013.01)

(58) Field of Classification Search
CPC .. H01Q 1/50; H01Q 1/48; H01Q 3/34; H01Q 21/0075; H01Q 21/065; H01Q 3/40; H01Q 1/38; H01Q 3/30; H01Q 21/0006; H01Q 21/061; H01Q 1/1271; H01Q 1/3291; H01Q 7/00; H01Q 1/3208; H01Q 5/20; H01Q 21/28; H01Q 1/1278; H01Q 1/32; H01P 3/081; H01P 3/088; H04B 1/3822; H04B 1/1027; H04B 1/12; H04B 1/40; H04B 1/50; B60R 11/02; H03D 2200/0086
See application file for complete search history.

(56) References Cited

U.S. PATENT DOCUMENTS 5,297,168 A * 3/1994 Sant'Agostino ..... H04B 7/0857 375/229
5,345,602 A * 9/1994 Wiedemann ..... H04B 7/084 455/137

(Continued)

FOREIGN PATENT DOCUMENTS

EP 1686704 A2 * 8/2006 ..... H04B 7/0802
JP 2005348316 A * 12/2005 ..... H01Q 1/46

(Continued)

*Primary Examiner* — Hai V Tran
*Assistant Examiner* — Bamidele A Immanuel
(74) *Attorney, Agent, or Firm* — Morgan, Lewis & Bockius LLP

(57) ABSTRACT

An antenna system of a vehicle includes a glass antenna installed on a surface of a glass of the vehicle, configured to receive a first broadcast signal and a second broadcast signal; and a broadcasting receiver configured to receive the first broadcast signal and the second broadcast signal, and to cancel and remove a harmonic components of the first broadcast signal from the second broadcast signal. The antenna system can ensure a free space of a loop antenna by implementing an integrated glass antenna, and realize installing an additional antenna module in the free space of the loop antenna.

17 Claims, 11 Drawing Sheets

(56) References Cited

U.S. PATENT DOCUMENTS 5,602,558 A * 2/1997 Urakami ..... H03H 7/38 343/850
5,710,995 A * 1/1998 Akaiwa ..... H04B 7/0874 375/347
5,838,742 A * 11/1998 Abu-Dayya ..... H04L 1/06 375/347
6,091,458 A * 7/2000 Jeon ..... H04N 21/42638 348/554
6,097,773 A * 8/2000 Carter ..... H04B 7/0851 375/347
6,141,536 A * 10/2000 Cvetkovic ..... H04B 7/0871 455/134
6,236,844 B1 * 5/2001 Cvetkovic ..... H04B 7/0857 375/347
2001/0016478 A1 * 8/2001 Lindenmeier ..... H04B 7/0874 455/277.1
2002/0168955 A1 * 11/2002 Wildhagen ..... H04B 7/0857 455/277.1
2003/0125003 A1 * 7/2003 Whikehart ..... H01Q 3/26 455/277.2
2005/0059370 A1 * 3/2005 Sugiyama ..... H04B 1/16 455/179.1
2006/0053453 A1 * 3/2006 Kasamatsu ..... H04N 21/43637 725/81
2006/0104643 A1 * 5/2006 Lee ..... H04B 10/25758 398/115
2006/0148432 A1 * 7/2006 Chu ..... H04B 7/0814 455/134
2007/0129020 A1 * 6/2007 Anton-Becker ..... H04B 7/082 455/78
2007/0142011 A1 * 6/2007 Shatara ..... H04B 7/0802 455/222
2007/0165743 A1 * 7/2007 McCallister ..... H03F 1/3247 375/296
2007/0173288 A1 * 7/2007 Skarby ..... H04W 88/08 455/562.1
2008/0246672 A1 * 10/2008 Sliskovic ..... H04B 7/084 343/713
2008/0261548 A1 * 10/2008 Krone ..... H03D 3/006 455/205
2008/0299902 A1 * 12/2008 Shin ..... H04B 1/30 455/39
2009/0003498 A1 * 1/2009 Fruit ..... H04B 7/0857 375/347
2015/0142139 A1 * 5/2015 Manssen ..... G05B 13/02 700/37
2018/0132192 A1 * 5/2018 Yang ..... H04W 52/245
2019/0273302 A1 * 9/2019 Dai ..... H01Q 1/325

FOREIGN PATENT DOCUMENTS

KR 100227166 B1 * 10/1999 ..... H01Q 1/1271
KR 20080072584 A * 8/2008 ..... H01Q 1/325

* cited by examiner

VEHICLE AND ANTENNA SYSTEM OF VEHICLE

CROSS-REFERENCE TO RELATED APPLICATION(S)

The present application is based on and claims the benefit of priority to Korean Patent Application No. 10-2019-0171644, filed on Dec. 20, 2019 in the Korean Intellectual Property Office, the disclosure of which is incorporated by reference in its entirety.

TECHNICAL FIELD

The disclosure relates to a vehicle, and more particularly, to an antenna system of the vehicle.

BACKGROUND

A vehicle is equipped with an antenna for communication and broadcast reception. The antenna of the vehicle includes, for example, a shark fin antenna or a poll type antenna installed in a roof, and a glass antenna installed in a strip form on a rear glass. In general, a loop antenna is provided with an antenna module for communication and an antenna module for digital broadcasting, and a glass antenna is provided with an antenna module for radio broadcasting.

The loop antenna is installed to protrude from the roof of the vehicle. Therefore, the loop antenna is limited in size because the loop antenna requires consideration of resistance and design factors while the vehicle is driving. That is, the size of the loop antenna should not be too large.

In the trend that more antenna modules need to be disposed on the vehicle due to the increase of vehicle connected service, a countermeasure is needed because of insufficient space for installing an additional antenna module due to the limitation of the size of the loop antenna.

The information disclosed in the Background section above is to aid in the understanding of the background of the present disclosure, and should not be taken as acknowledgement that this information forms any part of prior art.

SUMMARY

Therefore, an aspect of the disclosure is to ensure a free space of a loop antenna by implementing an integrated glass antenna, and to install an additional antenna module in the free space of the loop antenna.

Additional aspects of the disclosure will be set forth in part in the description which follows and, in part, will be obvious from the description, or may be learned by practice of the disclosure.

In accordance with an aspect of the disclosure, an antenna system of a vehicle includes a glass antenna disposed on a surface of a glass of the vehicle, configured to receive a first broadcast signal and a second broadcast signal; and a broadcasting receiver configured to receive the first broadcast signal and the second broadcast signal transmitted from the glass antenna, and to cancel and remove a harmonic components of the first broadcast signal from the second broadcast signal.

The first broadcast signal is a radio broadcast signal. The second broadcast signal is a digital broadcast signal. The harmonic component of the first broadcast signal is an FM harmonic component of the radio broadcast signal.

The broadcasting receiver may be configured to extract the harmonic component of the radio broadcast signal, to invert a phase of the extracted harmonic component; and to cancel and remove the harmonic component included in the digital broadcast signal by adding the harmonic component of which the phase is inverted to the digital broadcast signal.

The glass antenna may include a first glass antenna configured to receive signals of some channels of the first broadcast signal and some channels of the second broadcast signal; and a second glass antenna configured to receive signals of remaining channels of the first broadcast signal and remaining channels of the second broadcast signal.

The received signal of the first glass antenna may include an AM signal, a first FM signal, and a first DMB signal. The received signal of the second glass antenna may include a second FM signal and a second DMB signal.

In accordance with another aspect of the disclosure, an antenna system of a vehicle includes a glass antenna disposed on a surface of a glass of the vehicle, configured to receive a first broadcast signal and a second broadcast signal; and a broadcasting receiver configured to receive the first broadcast signal and the second broadcast signal transmitted from the glass antenna, to extract a harmonic component of the first broadcast signal from a transmission path of the first broadcast signal, to invert the extracted harmonic component, and to cancel and remove a harmonic component of the first broadcast signal from the second broadcast signal by adding the harmonic component of which the phase is inverted to a transmission path of the second broadcast signal.

The first broadcast signal is a radio broadcast signal. The second broadcast signal is a digital broadcast signal. The harmonic component of the first broadcast signal is an FM harmonic component of the radio broadcast signal.

The glass antenna may include a first glass antenna configured to receive signals of some channels of the first broadcast signal and some channels of the second broadcast signal; and a second glass antenna configured to receive signals of remaining channels of the first broadcast signal and remaining channels of the second broadcast signal.

The received signal of the first glass antenna may include an AM signal, a first FM signal, and a first DMB signal. The received signal of the second glass antenna may include a second FM signal and a second DMB signal.

The transmission path of the first broadcast signal may include a first preprocessor configured to preprocess the first broadcast signal. The transmission path of the second broadcast signal may include a second preprocessor configured to preprocess the second broadcast signal.

The broadcasting receiver may further include a band pass filter configured to extract a harmonic component from an output signal of the first preprocessor; a phase inverter configured to invert a phase of the harmonic component extracted by the band pass filter; and an adder configured to add the harmonic component of which the phase is inverted to the second broadcast signal input to the second preprocessor.

In accordance with another aspect of the disclosure, an antenna system of a vehicle includes a glass antenna disposed on a surface of a glass of the vehicle, configured to receive a first broadcast signal and a second broadcast signal; and a broadcasting receiver configured to receive the first broadcast signal and the second broadcast signal transmitted from the glass antenna, to perform a preprocessing of each of the first broadcast signal or the second broadcast signal through a single wideband signal preprocessor, and when receiving the second broadcast signal, to cancel and remove a harmonic component of the first broadcast signal from the second broadcast signal by adding a harmonic component of which the phase of the first broadcast signal is inverted to a transmission path of the second broadcast signal.

The first broadcast signal is a radio broadcast signal. The second broadcast signal is a digital broadcast signal. The harmonic component of the first broadcast signal is an FM harmonic component of the radio broadcast signal.

The glass antenna may include a first glass antenna configured to receive signals of some channels of the first broadcast signal and some channels of the second broadcast signal; and a second glass antenna configured to receive signals of remaining channels of the first broadcast signal and remaining channels of the second broadcast signal.

The received signal of the first glass antenna may include an AM signal, a first FM signal, and a first DMB signal. The received signal of the second glass antenna may include a second FM signal and a second DMB signal.

The broadcasting receiver may further include a channel selector configured to selectively receive one of the first broadcast signal and the second broadcast signal in response to a user's channel selection; and a tunable filter configured to selectively pass the broadcast signal of a channel selected by the user among the first broadcast signal and the second broadcast signal output from the wideband signal preprocessor.

The broadcast signal may be selected from the glass antenna, the channel selector, the wideband signal preprocessor, and the tunable filter according to a control command generated by the user's channel selection.

The user's channel selection may be performed through an operation of a head unit connected to the antenna system of the vehicle.

In accordance with another aspect of the disclosure, a vehicle includes a glass antenna disposed on a surface of a glass of the vehicle, configured to receive a first broadcast signal and a second broadcast signal; and a broadcasting receiver configured to receive the first broadcast signal and the second broadcast signal transmitted from the glass antenna, and to cancel and remove a harmonic components of the first broadcast signal from the second broadcast signal.

The first broadcast signal is a radio broadcast signal. The second broadcast signal is a digital broadcast signal. The harmonic component of the first broadcast signal is an FM harmonic component of the radio broadcast signal.

The broadcasting receiver may be configured to extract the harmonic component of the radio broadcast signal, to invert a phase of the extracted harmonic component; and to cancel and remove the harmonic component included in the digital broadcast signal by adding the harmonic component of which the phase is inverted to the digital broadcast signal.

The glass antenna may include a first glass antenna configured to receive signals of some channels of the first broadcast signal and some channels of the second broadcast signal; and a second glass antenna configured to receive signals of remaining channels of the first broadcast signal and remaining channels of the second broadcast signal.

The received signal of the first glass antenna may include an AM signal, a first FM signal, and a first DMB signal. The received signal of the second glass antenna may include a second FM signal and a second DMB signal.

The vehicle may further include a loop antenna installed on a roof of the vehicle and equipped with a plurality of antenna modules for communication; and a communication receiver configured to receive a communication signal through the plurality of antenna modules for communication.

BRIEF DESCRIPTION OF THE DRAWINGS

These and/or other aspects of the disclosure will become apparent and more readily appreciated from the following description of the embodiments, taken in conjunction with the accompanying drawings of which:

As illustrated in FIG. 9, a diversity antenna system has a higher reception signal quality compared to a reception distance than a single antenna system.

DETAILED DESCRIPTION

Figure 1:
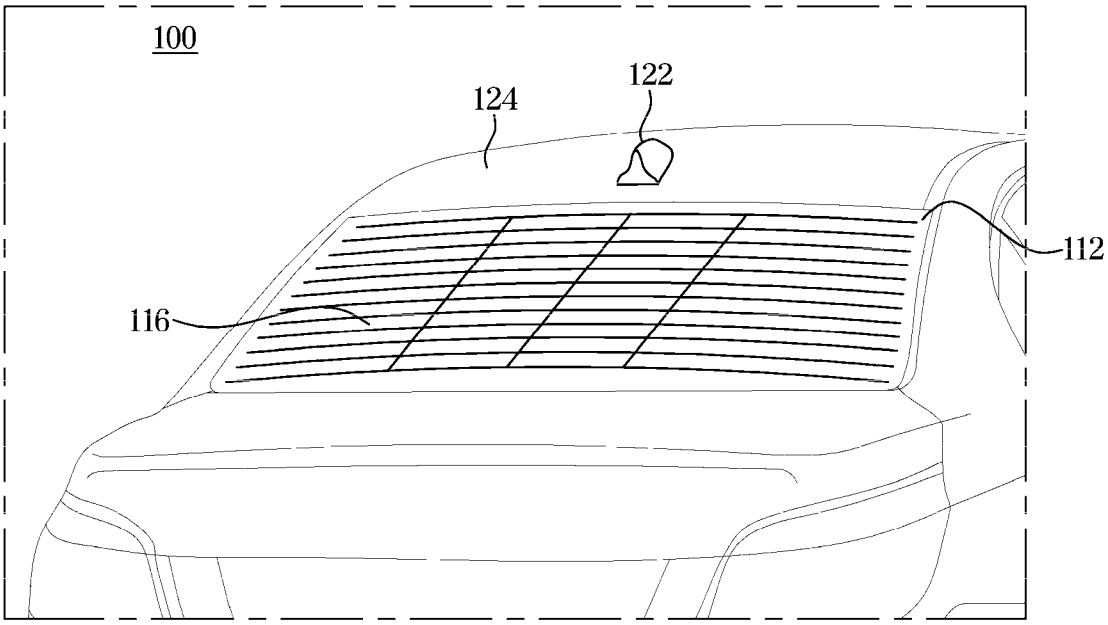
FIG. 1 is a view illustrating a control system of a vehicle according to exemplary embodiments of the disclosure.

FIG. 1 is a view illustrating a control system of a vehicle according to exemplary embodiments of the disclosure.

Referring to FIG. 1, an antenna of a vehicle 100 may include a glass antenna 116 and a loop antenna 122. The glass antenna 116 may be installed to form a pattern of a certain shape on the surface of a rear glass 112 of the vehicle 100. The loop antenna 122 may be installed on the surface of a roof 124 of the vehicle 100. The loop antenna 122 may be a 'shark fin antenna' or a 'poll antenna'. In an exemplary embodiment of the disclosure, a description will be given taking the "shark fin antenna" type as an example.

Figure 2:
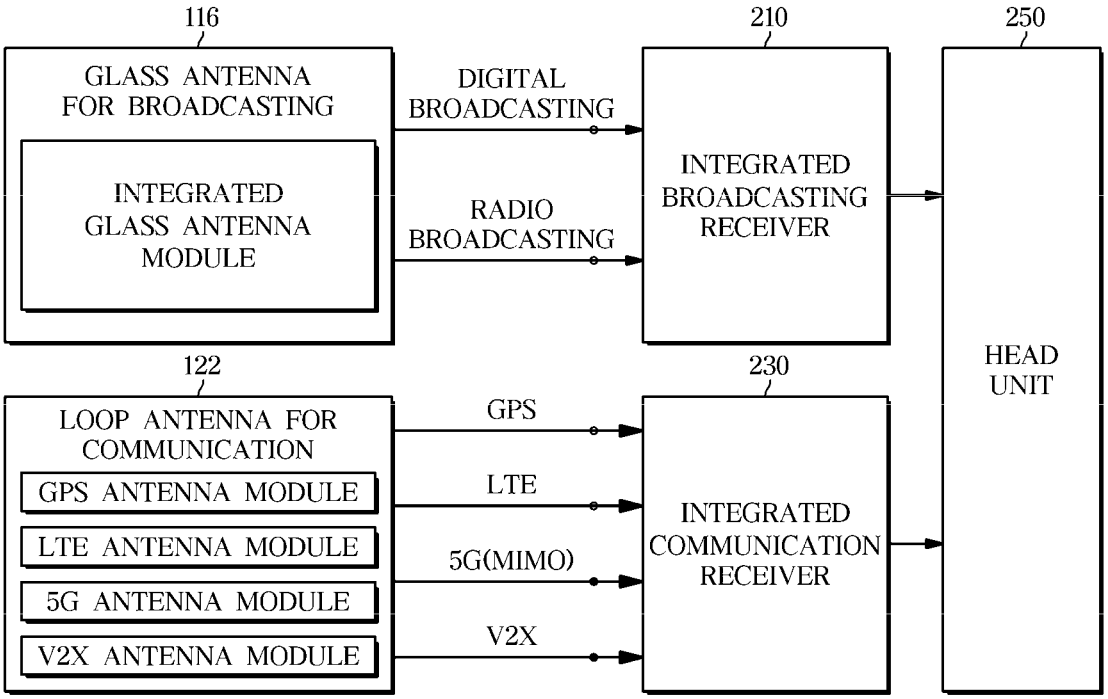
FIG. 2 is a view illustrating an antenna system of a vehicle according to exemplary embodiments of the disclosure.

FIG. 2 is a view illustrating an antenna system of a vehicle according to exemplary embodiments of the disclosure.

Referring to FIG. 2, the glass antenna 116 is an integrated glass antenna for broadcasting, and may receive broadcast signals of radio broadcasting and digital broadcasting (digital multimedia broadcasting (DMB), digital audio broadcasting (DAB), etc.). An exemplary embodiment of the disclosure will be described based on DMB broadcasting as an example of digital broadcasting. The glass antenna 116 may include an integrated glass antenna module. The integrated glass antenna module of the glass antenna 116 has a structure of which one antenna (or an integrated antenna) receives both a radio broadcast signal and a digital broadcast signal.

The digital broadcast signal and the radio broadcast signal received through the glass antenna 116 are transmitted to an integrated broadcasting receiver 210, and after passing through a series of signal processing processes in the integrated broadcasting receiver 210, are transmitted to a head unit 250. The head unit 250 may output the content of the broadcast signal through a speaker or a display.

In addition, as illustrated in FIG. 2, the loop antenna 122 may receive various types of communication signals such as global positioning system (GPS) signals, long term evolution (LTE) signals, 5G (MIMO; Multi-Input Multi-Output) signals, and vehicle-to-everything (V2X) signals. To this end, the loop antenna 122 may include a GPS antenna module, an LTE antenna module, a 5G (MIMO) antenna module, and a V2X antenna module.

The GPS signals, the LTE signals, the 5G (MIMO) signals, and the V2X signals received through the loop antenna 122 are transmitted to an integrated communication receiver 230, and after passing through a series of signal processing processes in the integrated communication receiver 230, are transmitted to the head unit 250. The head unit 250 may output the content of the communication signal through the speaker or the display.

As described above with reference to FIG. 1, the loop antenna 122 of the vehicle 100 may be the 'shark fin antenna' or the 'poll antenna'. Since the 'shark fin antenna' or 'poll antenna' is limited in size because the 'shark fin antenna' or 'poll antenna' requires consideration of resistance and design factors while the vehicle is driving. That is, it is difficult for the 'shark fin antenna' or 'poll antenna' to be too large. In an exemplary embodiment of the disclosure, a digital broadcasting antenna installed in an existing loop antenna is implemented by the integrated glass antenna 116 for broadcasting, and thus, the 5G (MIMO) antenna module and the V2X antenna module may be installed in a free space secured by the loop antenna 122. If the digital broadcasting antenna is installed in the loop antenna as in an conventional case, it is difficult to secure a space for installing an additional antenna module such as the 5G (MIMO) antenna module and the V2X antenna module.

In an exemplary embodiment of the disclosure, by integrating the antenna module for radio broadcasting and the antenna module for digital broadcasting to implement a single integrated glass antenna 116 for broadcasting to secure the free space in the loop antenna 122. By installing the additional antenna module for communication, such as the 5G (MIMO) antenna module and the V2X antenna module, the 5G (MIMO) antenna module and the V2X antenna module for a new connected service of the vehicle 100 may be additionally installed in the loop antenna 122 without increasing a size of the loop antenna 122 (that is, maintaining an existing size), etc. In addition, by separately installing the antenna module for communication and the antenna module for broadcasting in each of the glass and the roof, it is easy to prepare an isolation measure and prevent the performance degradation due to mutual interference between the antenna module for communication and the antenna module for broadcasting in advance.

The glass antenna 116 may be integrated to receive both the radio broadcast signal and the digital broadcast signal because frequency bands on the radio broadcast signal and the digital broadcast are in a harmonic relationship with each other. That is, the frequency band of radio broadcasting is 88-108 MHz, and the frequency band of digital broadcasting is 174-240 MHz, and it has the harmonic relationship with each other. In addition, the radio broadcasting and the digital broadcasting are not simultaneously received. For this reason, the glass antenna 116 may be used jointly for the reception of the radio broadcast signal and the digital broadcast signal despite being a single integrated form.

Figure 3:
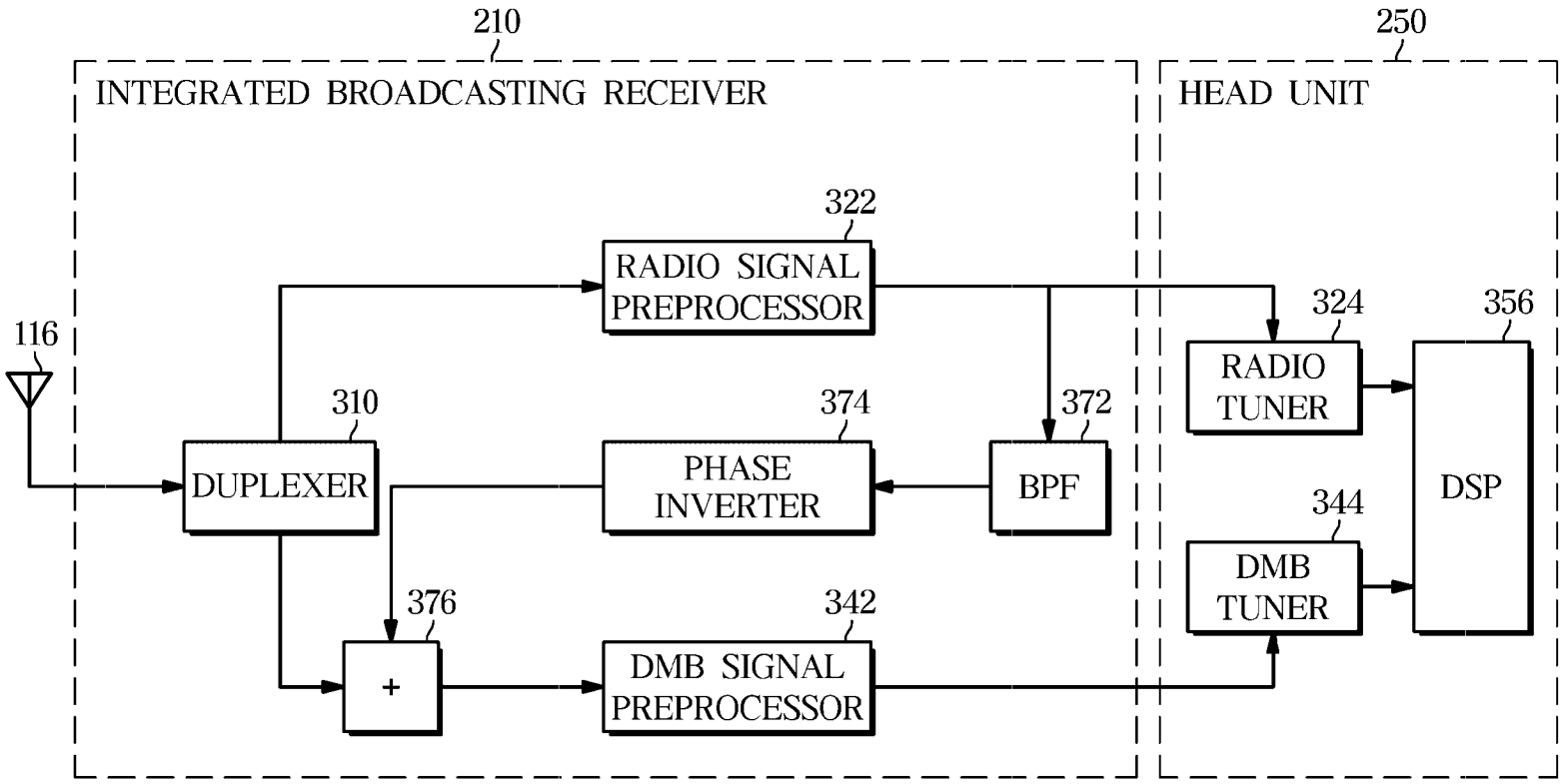
FIG. 3 is a view illustrating an integrated broadcasting receiver (analog method) of a vehicle according to exemplary embodiments of the disclosure.

FIG. 3 is a view illustrating an integrated broadcasting receiver (analog method) of a vehicle according to exemplary embodiments of the disclosure.

Referring to FIG. 3, the integrated broadcasting receiver 210 of an analog method may include a duplexer 310, a radio signal preprocessor 322, a DMB signal preprocessor 342, a band pass filter 372, a phase inverter 374, and an adder 376.

The duplexer 310 is for enabling the single integrated broadcast glass antenna 116 to be used jointly for transmission and reception. The glass antenna 116 may simultaneously transmit and receive signals of different frequency bands, and may also transmit signals of different frequency bands when receiving the signal of one frequency band. Among the signals received through the glass antenna 116, the broadcast signal is selected by the duplexer 310 and transmitted to the radio signal preprocessor 322 or the DMB signal preprocessor 342.

The radio signal preprocessor 322 may perform preprocessing such as noise removal and amplification of the radio broadcast signal (for example, an FM radio broadcast signal) among the received broadcast signals. In the radio signal preprocessor 322, the preprocessed signal by radio signal preprocessor 322 may be transmitted to a radio tuner 324 of the head unit 250.

The DMB signal preprocessor 342 may perform preprocessing such as noise removal and amplification of the digital broadcast signal (for example, the DMB broadcast signal or the DAB broadcast signal) among the received broadcast signals. The preprocessed signal by the DMB signal preprocessor 342 may be transmitted to a DMB tuner 344 of the head unit 250. In FIG. 3, reference numeral 356 denotes a digital signal processor of the head unit 250.

In the integrated broadcasting receiver 210, the band pass filter 372, the phase inverter 374, and the adder 376 are devices (e.g., electronic circuits) for canceling interference and correcting gain attenuation that may occur when receiving radio broadcast signals and digital broadcast signals with a single integrated antenna. The glass antenna 116 may integrate the radio broadcasting antenna and the digital broadcasting antenna. In this case, mutual interference and gain attenuation may occur in a process of receiving signals of different bands.

The digital broadcast signal (DMB signal) received through the glass antenna 116 may include radio band harmonics (e.g., FM band harmonics) along with an original broadcast signal. The FM band harmonics may act as an interference to the DMB signal. The interference may also cause the gain attenuation in the DMB signal. Therefore, the integrated broadcasting receiver 210 may use the band pass filter 372, the phase inverter 374, and the adder 376 to reduce the mutual interference and the gain attenuation. The operation of the band pass filter 372, the phase inverter 374, and the adder 376 of the integrated broadcasting receiver 210 will be described in detail with reference to FIG. 4.

Figure 4:
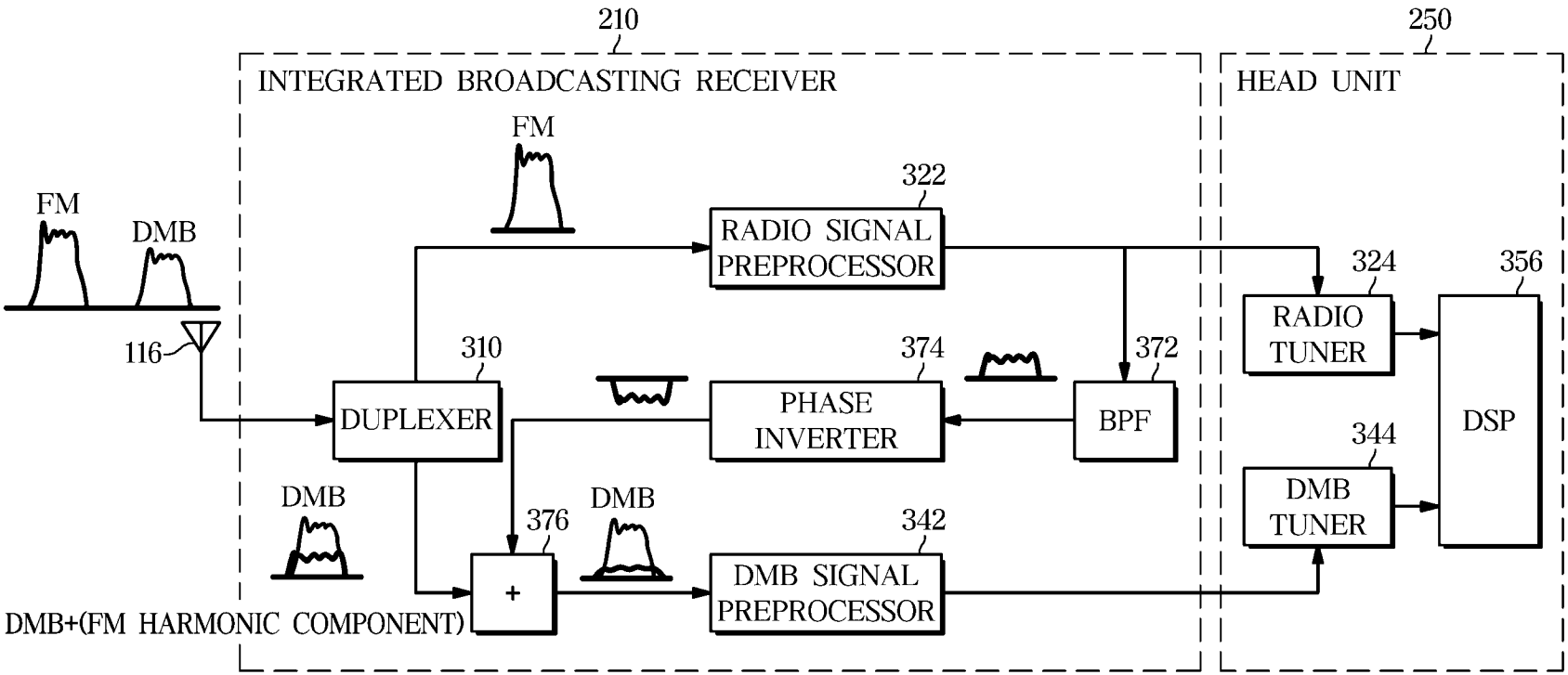
FIG. 4 is a view illustrating an operation of an integrated broadcasting receiver (analog method) according to exemplary embodiments of the disclosure.

FIG. 4 is a view illustrating an operation of an integrated broadcasting receiver (analog method) according to exemplary embodiments of the disclosure.

The glass antenna 116 may receive the radio broadcast signal (FM signal) or the digital broadcast signal (DMB signal). When the FM signal is received, a secondary harmonic component of the FM signal may be extracted through the band pass filter 372 in a path through which the FM signal is transmitted, and the extracted secondary harmonic component may be inverted in phase through the phase inverter 374, and the secondary harmonic component of which phase is inverted may be transmitted to adder 376.

Subsequently, when the DMB signal is received, by adding the secondary harmonic component of the FM signal whose phase is inverted at the front end of the DMB signal preprocessor 342 with the DMB signal through the adder 376, the harmonic of the FM signal included in the DMB signal may be canceled out. The DMB signal preprocessor 342 may receive a signal from which the FM harmonic component is removed from the received DMB signal. As the FM harmonic component is removed from the DMB signal, the mutual interference and the gain attenuation that may be caused by the FM harmonic component may be reduced.

Figure 5:
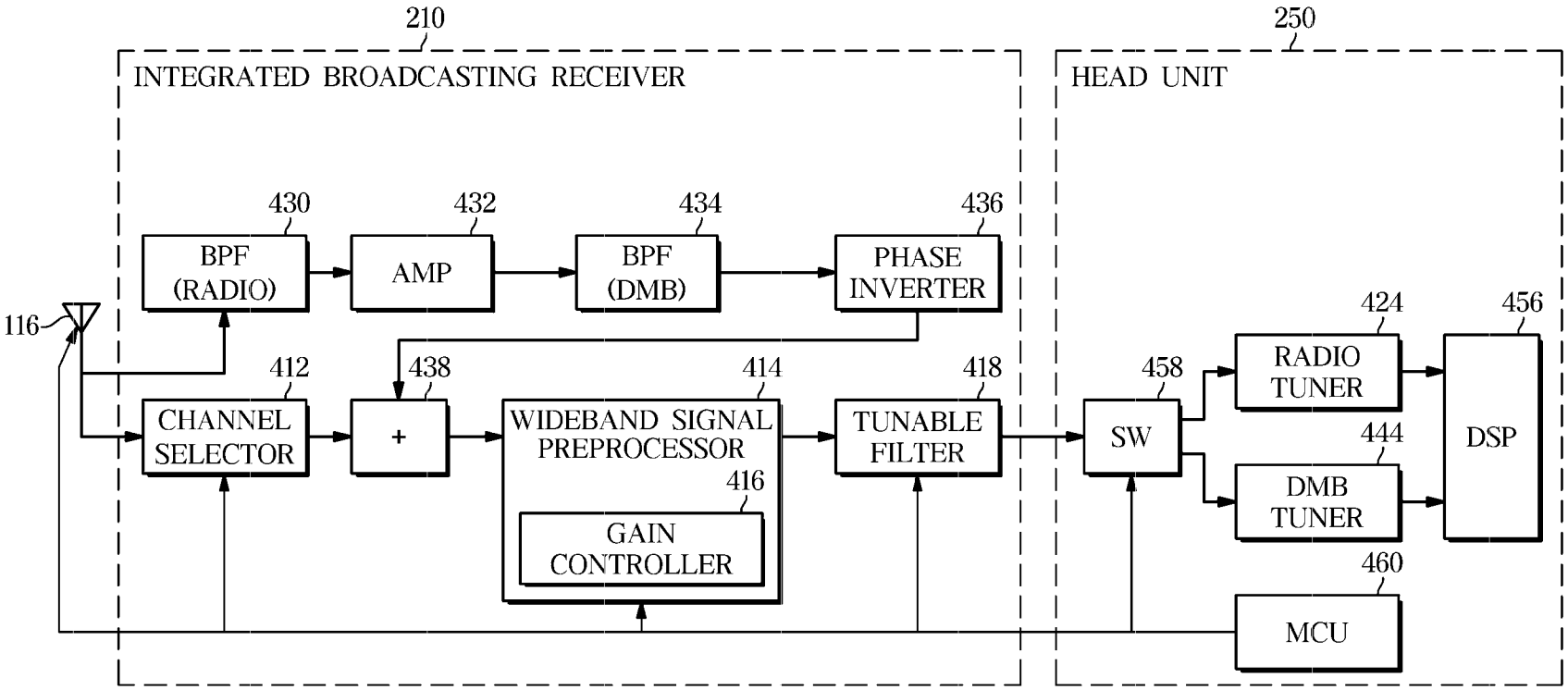
FIG. 5 is a view illustrating an integrated broadcasting receiver (digital method) according to exemplary embodiments of the disclosure.

FIG. 5 is a view illustrating an integrated broadcasting receiver (digital method) according to exemplary embodiments of the disclosure.

Referring to FIG. 5, the integrated broadcasting receiver 210 of a digital method may include a channel selector 412, a wideband signal preprocessor 414, a tunable filter 418, a radio band pass filter 430, an amplifier 432, and a DMB band pass filter 434, a phase inverter 436, and an adder 438. Unlike the integrated broadcasting receiver 210 of the analog method illustrated in FIG. 4 operating by separating a path of the radio broadcast signal and a path of the digital broadcast signal, the integrated broadcasting receiver 210 of the digital method illustrated in FIG. 5 may process both of the radio broadcast signal and the digital broadcast signal using a single channel selector 412, a single wideband signal preprocessor 414, and a single tunable filter 418. For this purpose, the channel selector 412, the wideband signal preprocessor 414, and the tunable filter 418 illustrated in FIG. 5 are preferably designed to correspond to the multi-band of the frequency band of the radio broadcast signal and the frequency band of the digital broadcast signal.

The channel selector 412 may be provided to select one of a radio channel and a digital broadcast channel. When the user (driver) selects either radio listening or digital broadcasting viewing through the operation of the head unit 250, the controller (MCU) 460 of the head unit 250 may generate a control signal to cause the channel selector 412 to select the frequency of the broadcast selected by the user (driver).

In the integrated broadcasting receiver 210 of the digital method illustrated in FIG. 5, the signal received through the glass antenna 116 is input to the channel selector 412 but passes through another path consisting of the radio band pass filter 430, the amplifier 432, the DMB band pass filter 434, the phase inverter 436, and the adder 438. The radio band pass filter 430, the amplifier 432, the DMB band pass filter 434, the phase inverter 436, and the adder 438 are devices for canceling the interference and correcting the gain attenuation that may occur when receiving the radio broadcast signals and the digital broadcast signals with the single integrated antenna. The glass antenna 116 may integrate the radio broadcasting antenna and the digital broadcasting antenna. In this case, the mutual interference and the gain attenuation may occur in the process of receiving signals of different bands.

The digital broadcast signal (DMB signal) received through the glass antenna 116 may include radio band harmonics (e.g., FM band harmonics) along with the original broadcast signal. The FM band harmonics may act as the interference to the DMB signal. The interference may also cause the gain attenuation in the DMB signal. Therefore, the integrated broadcasting receiver 210 may use the radio band pass filter 430, the amplifier 432, the DMB band pass filter 434, the phase inverter 436, and the adder 438 to reduce the mutual interference and the gain attenuation. The operation of the radio band pass filter 430, the amplifier 432, the DMB band pass filter 434, the phase inverter 436, and the adder 438 of the integrated broadcasting receiver 210 will be described in detail with reference to FIGS. 6 and 7.

Figure 6:
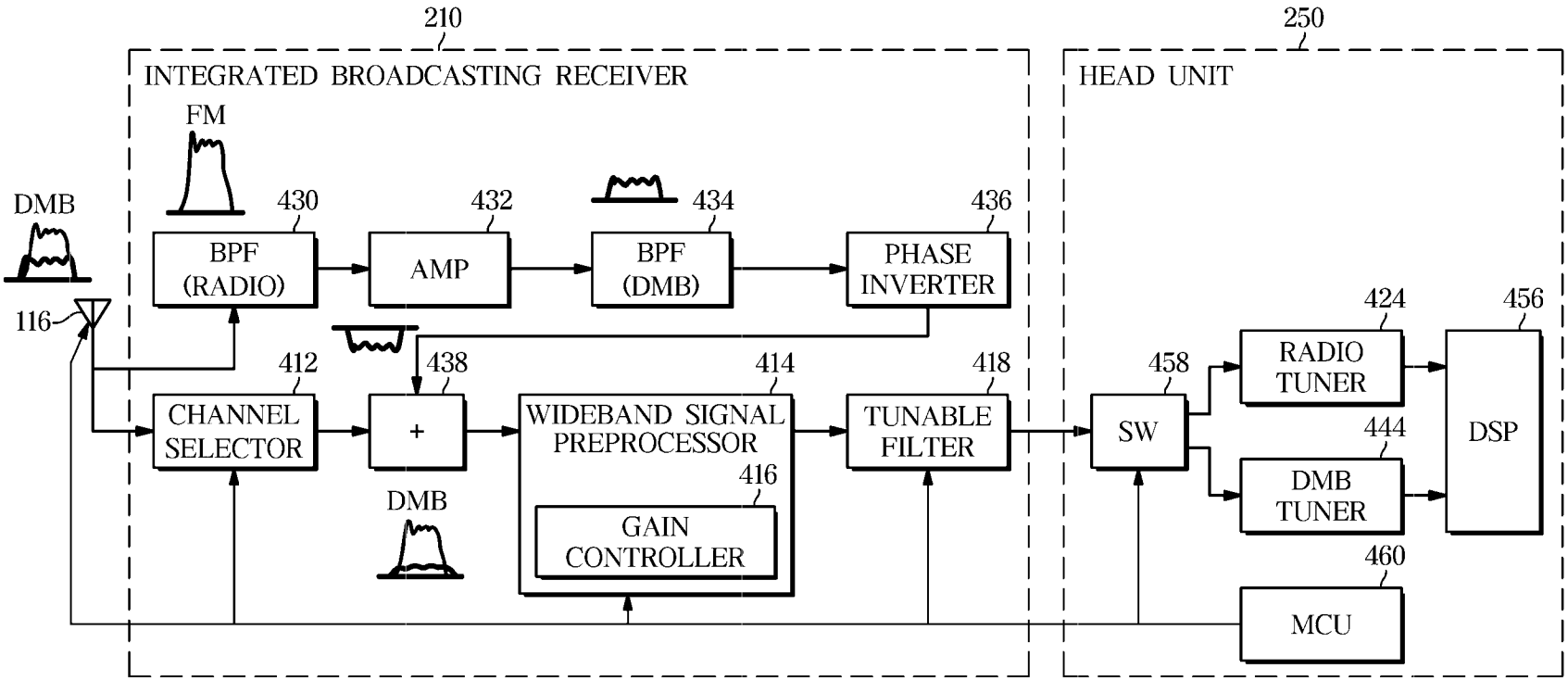
FIG. 6 is a view illustrating an operation of receiving digital broadcasting by an integrated broadcasting receiver (digital method) according to exemplary embodiments of the disclosure.

FIG. 6 is a view illustrating an operation of receiving digital broadcasting by an integrated broadcasting receiver (digital method) according to exemplary embodiments of the disclosure. In particular, FIG. 6 is a view illustrating a case of receiving the DMB broadcasting.

The glass antenna 116 may receive the radio broadcast signal (FM signal) or the digital broadcast signal (DMB signal). When the user (driver) selects the viewing of the digital broadcasting through the head unit 250 of FIG. 5, the controller 460 of the head unit 250 may generate a control signal to cause the channel selector 412 to select the digital broadcast signal. The received digital broadcast signal may be transmitted to the wideband signal preprocessor 414 via the adder 438. The wideband signal preprocessor 414 may perform preprocessing such as noise cancellation, amplification, and gain control of the received digital broadcast signal. The gain controller 416 may adjust a gain value to fit the digital broadcast signal through current control.

The tunable filter 418 may filter only the digital broadcast signal from the signal passing through the wideband signal preprocessor 414 and transmit the digital broadcast signal to the head unit 250.

In the head unit 250, a switch 458 may be operated under the control of the controller 460 to transmit a signal passing through the tunable filter 418 to either a radio tuner 424 or a DMB tuner 444. FIG. 6 illustrates a case of receiving the digital broadcast signal, the digital broadcast signal (DMB signal) passing through the tunable filter 418 may be transmitted to the DMB tuner 444 through the switch 458. The head unit 250 may output the content of the digital broadcast signal through the speaker or the display.

The glass antenna 116 may receive the radio broadcast signal (FM signal) or the digital broadcast signal (DMB signal). When the FM signal is received, the secondary harmonic component of the FM signal may be extracted through the radio band pass filter 430, the amplifier 432, and the DMB band pass filter 434 in the path through which the FM signal is transmitted, and the extracted secondary harmonic component may be inverted in phase through the phase inverter 436, and the secondary harmonic component of which phase is inverted may be transmitted to the adder 438.

When the DMB signal is received, by adding the secondary harmonic component of the FM signal whose phase is inverted at the front end of the wideband signal preprocessor 414 with the DMB signal through the adder 376, the harmonic of the FM signal included in the DMB signal may be canceled out. The wideband signal preprocessor 414 may receive a signal from which the FM harmonic component is removed from the received DMB signal. As the FM harmonic component is removed from the DMB signal, the mutual interference and the gain attenuation that may be caused by the FM harmonic component may be reduced.

Figure 7:
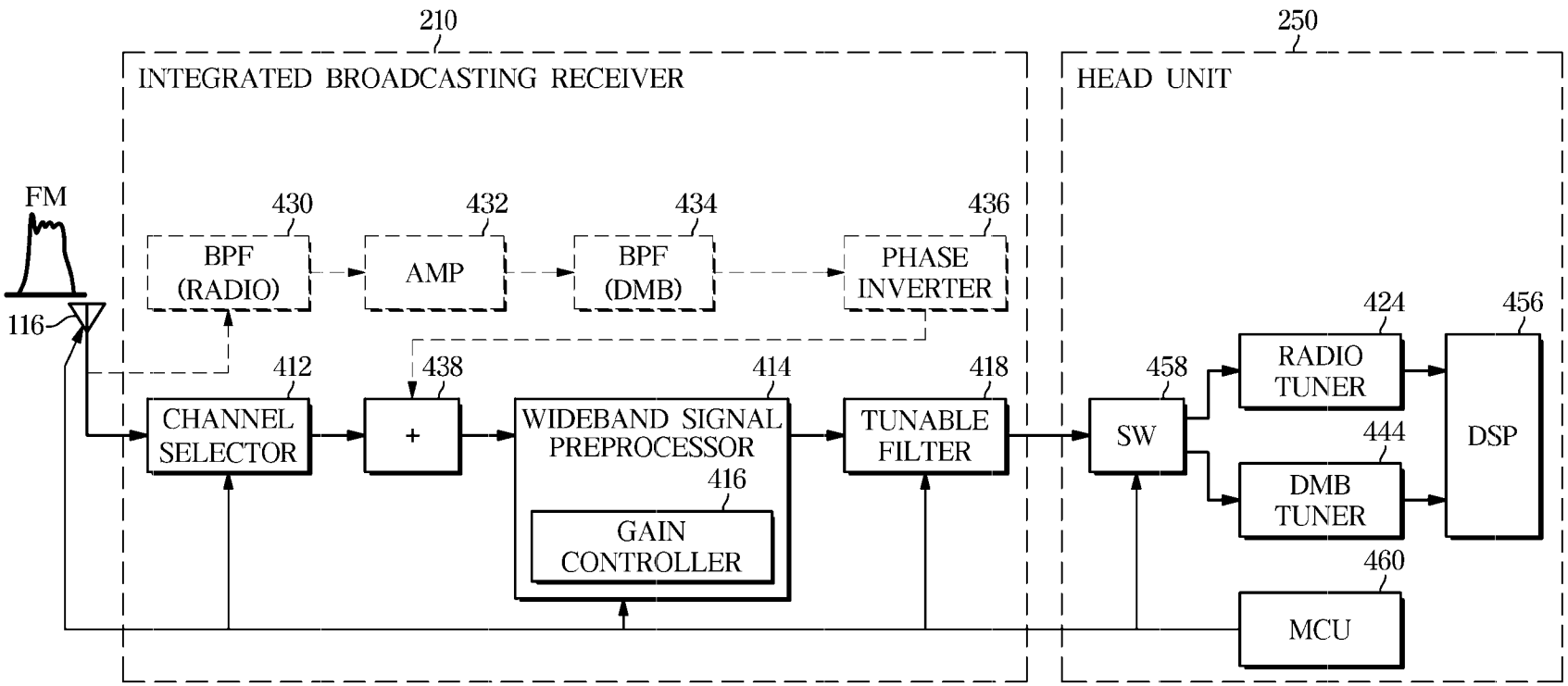
FIG. 7 is a view illustrating an operation of receiving a radio broadcast by the integrated broadcasting receiver (digital method) according to exemplary embodiments of the disclosure.

FIG. 7 is a view illustrating an operation of receiving a radio broadcast by the integrated broadcasting receiver (digital method) according to exemplary embodiments of the disclosure.

The glass antenna 116 may receive the radio broadcast signal (FM signal) or the digital broadcast signal (DMB signal). When the user (driver) selects the listening of the radio broadcasting through the head unit 250 of FIG. 5, the controller 460 of the head unit 250 may generate a control signal to cause the channel selector 412 to select the radio broadcast signal. The received radio broadcast signal may be transmitted to the wideband signal preprocessor 414 via the adder 438. The wideband signal preprocessor 414 may perform preprocessing such as noise cancellation, amplification, and gain control of the received radio broadcast signal. The gain controller 416 may adjust a gain value to fit the radio broadcast signal through current control.

The tunable filter 418 may filter only the radio broadcast signal from the signal passing through the wideband signal preprocessor 414 and transmit the radio broadcast signal to the head unit 250.

In the head unit 250, a switch 458 may be operated under the control of the controller 460 to transmit a signal passing through the tunable filter 418 to either a radio tuner 424 or a DMB tuner 444. FIG. 7 illustrates a case of receiving the radio broadcast signal, the radio broadcast signal passing through the tunable filter 418 may be transmitted to the radio tuner 424 through the switch 458. The head unit 250 may output the content of the radio broadcast signal through the speaker or the display.

In case of the digital broadcasting reception of FIG. 6 described above, the process of removing the FM harmonic component included in the digital broadcast signal is involved. However, in case of reception of the radio broadcast signal illustrated in FIG. 7, the FM harmonic component does not need to be considered. The FM harmonic component removal process using the radio band pass filter 430, the amplifier 432, the DMB band pass filter 434, the phase inverter 436, and the adder 438 is not necessary. Therefore, in case of the radio broadcasting reception shown in FIG. 7, the radio band pass filter 430, the amplifier 432, the DMB band pass filter 434, the phase inverter 436, and the adder 438 are deactivated.

Figure 8:
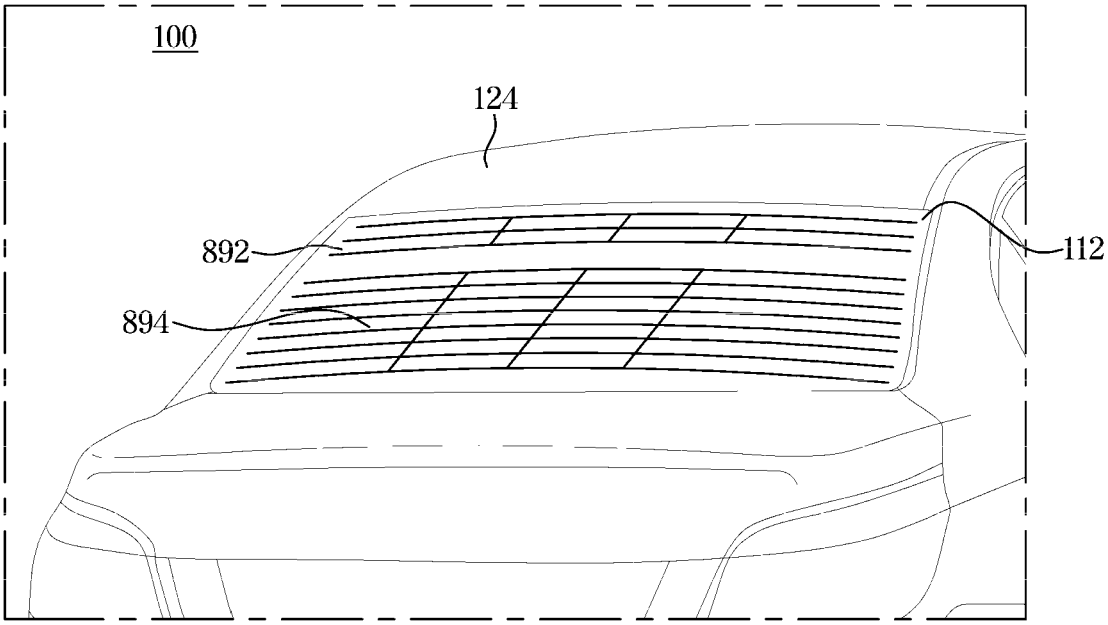
FIG. 8 is a view illustrating an antenna of a vehicle according to another exemplary embodiment of the disclosure.

FIG. 8 is a view illustrating an antenna of a vehicle according to another exemplary embodiment of the disclosure.

Referring to FIG. 8, an antenna of the vehicle 100 according to another exemplary embodiment of the disclosure may include two glass antennas 892 and 894. The two glass antennas 892 and 894 may be installed on the surface of the rear glass 112 of the vehicle 100 so as to be divided into upper and lower sides to form a pattern of a predetermined shape.

The glass antenna 892 located on the upper part of the rear glass 112 may be provided to receive radio signals such as AM/FM1/DMB1 and the DMB signals. The glass antenna 894 located on the lower part of the rear glass 112 may be provided to receive another radio signal such as FM2/DMB2 and the DMB signals. That is, an antenna diversity may be implemented by the two glass antennas 892 and 894, a signal separation block, and a diversity block, and both FM and DMB signals may be received through each of the two glass antennas 892 and 894, respectively (using a dual resonance method). When the antenna diversity is configured using the two glass antennas 892 and 894 as described above, since the two glass antennas 892 and 894 serve as both a glass antenna and a loop antenna, the roof 124 of the vehicle 100 does not need to be provided with the loop antenna.

In another exemplary embodiment of the disclosure, the two glass antennas 892 and 894 may be installed on the rear glass 112 of the vehicle 100 so as to be spaced apart by a distance of about 10 to 2λ. λ is a wavelength of the signal. Since signals received through the two glass antennas 892 and 894 have different phase shifts, the signals received through each of the two glass antennas 892 and 894 have low correlation with each other. The low correlation may mean that the signals received through each of the two glass antennas 892 and 894 are independent of each other in multipath fading, and thus, it is advantageous to transmit and receive a signal with low multipath fading.

The antenna diversity may be applied to both analog and digital methods. In particular, the antenna diversity may provide the effect of further improving signal reception performance.

Figure 9:
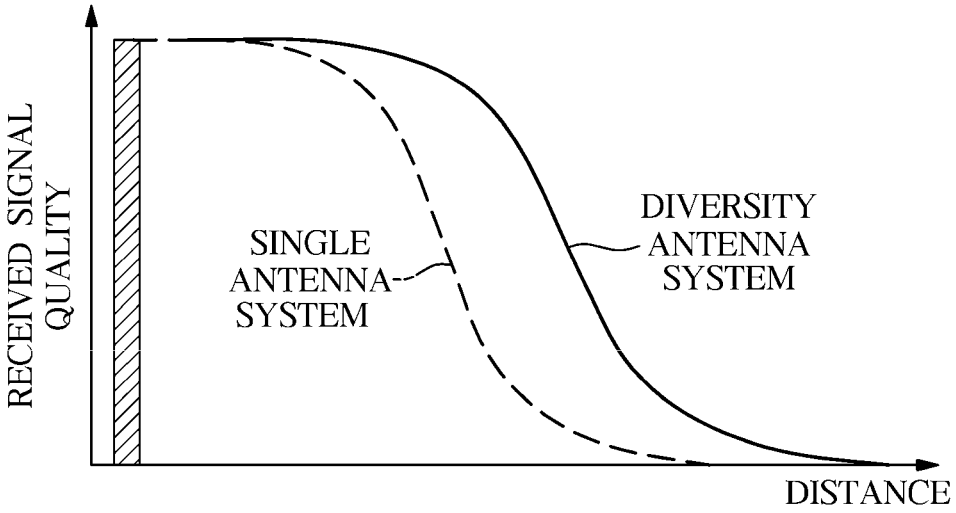
FIG. 9 is a view illustrating an improved reception effect of a diversity antenna according to another exemplary embodiment of the disclosure.

FIG. 9 is a view illustrating an improved reception effect of a diversity antenna according to another exemplary embodiment of the disclosure. As illustrated in FIG. 9, a diversity antenna system has a higher reception signal quality compared to a reception distance than a single antenna system.

Figure 10:
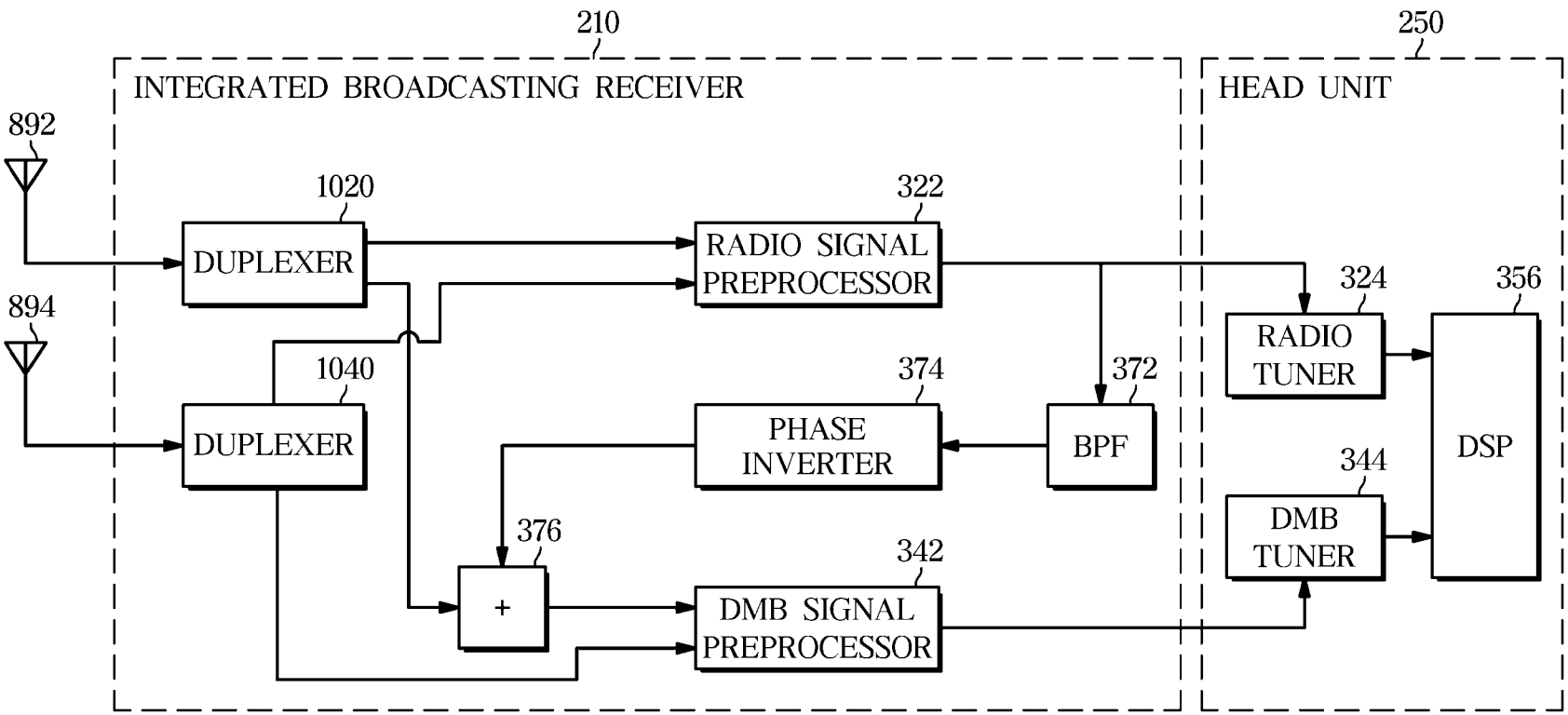
FIG. 10 is a view illustrating an integrated broadcasting receiver (analog method) of a vehicle according to another exemplary embodiment of the disclosure.

FIG. 10 is a view illustrating an integrated broadcasting receiver (analog method) of a vehicle according to another exemplary embodiment of the disclosure.

Referring to FIG. 10, the broadcasting receiver 210 of the analog method may include duplexers 1020 and 1040, the radio signal preprocessor 322, the DMB signal preprocessor 342, the band pass filter 372, the phase inverter 374, and the adder 376.

The two duplexers 1020 and 1040 jointly use each of the two integrated broadcast glass antennas 892 and 894 according to another embodiment of the disclosure for transmission and reception. That is, the broadcast signal among the signals received through the glass antenna 892 is selected by the duplexer 1020 and transmitted to the radio signal preprocessor 322 or the DMB signal preprocessor 342. Among the signals received through another glass antenna 894, the broadcast signal is selected by another duplexer 1040 and transmitted to the radio signal preprocessor 322 or the DMB signal preprocessor 342. Subsequent signal processing may be performed in the same manner as described above with reference to FIGS. 3 and 4.

Figure 11:
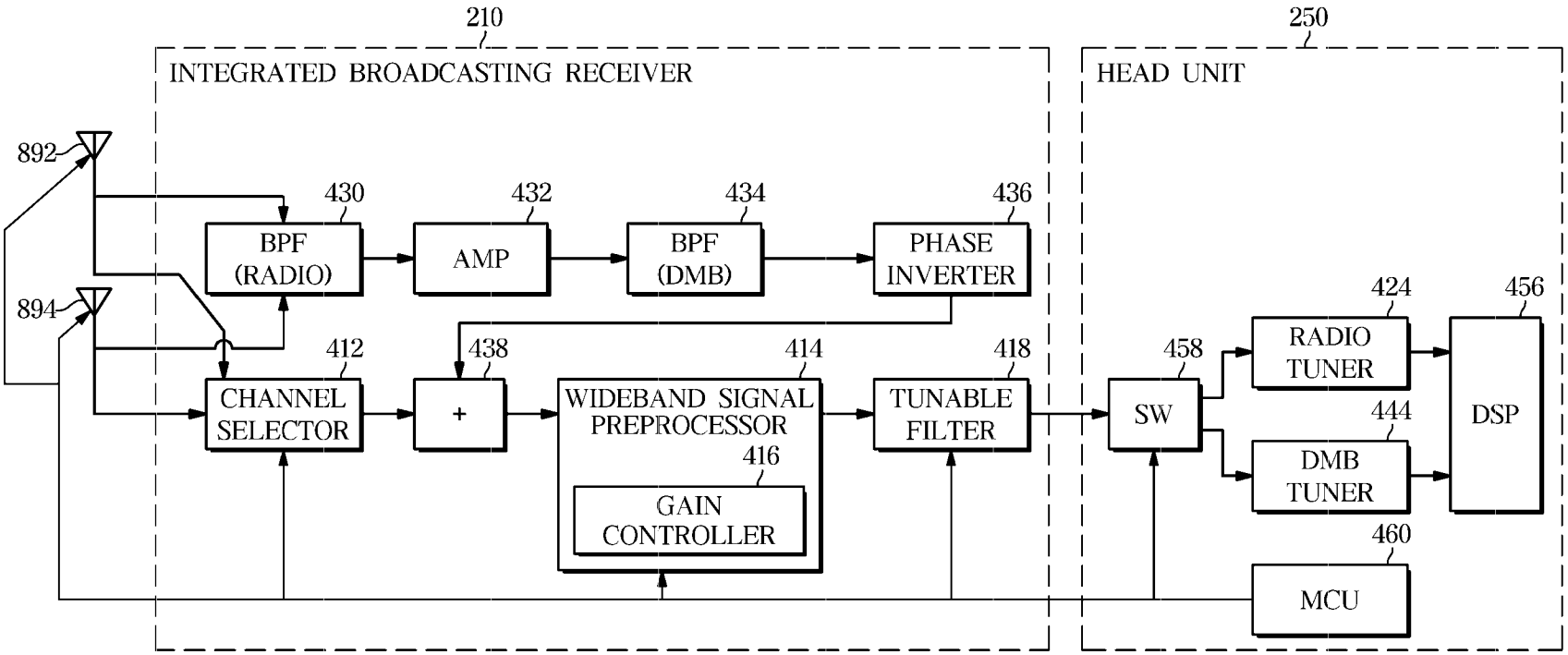
FIG. 11 is a view illustrating an integrated broadcasting receiver (digital method) of a vehicle according to another exemplary embodiment of the disclosure.

FIG. 11 is a view illustrating an integrated broadcasting receiver (digital method) of a vehicle according to another exemplary embodiment of the disclosure.

Referring to FIG. 11, the integrated broadcasting receiver 210 of the digital method may include the channel selector 412, the wideband signal preprocessor 414, the tunable filter 418, the radio band pass filter 430, the amplifier 432, and the DMB band pass filter 434, the phase inverter 436, and the adder 438. Unlike the integrated broadcasting receiver 210 of the analog method illustrated in FIG. 10 operating by separating the path of the radio broadcast signal and the path of the digital broadcast signal, the integrated broadcasting receiver 210 of the digital method illustrated in FIG. 11 may process both of the radio broadcast signal and the digital broadcast signal using a single channel selector 412, a single wideband signal preprocessor 414, and a single tunable filter 418. For this purpose, the channel selector 412, the wideband signal preprocessor 414, and the tunable filter 418 illustrated in FIG. 11 are preferably designed to correspond to the multiband of the frequency band of the radio broadcast signal and the frequency band of the digital broadcast signal.

The channel selector 412 may be provided to select one of the radio channel and the digital broadcasting channel of the signal received through each of the two glass antennas 892 and 894. To this end, the signal received through each of the two glass antennas 892 and 894 may be transmitted to both the channel selector 412 and the radio band pass filter 430. Subsequent signal processing may be performed in the same manner as described above with reference to FIGS. 5 to 7.

The above signal preprocessors 322, 342, and 414, according to one aspect of the present disclosure, may be implemented with various electronic circuits to perform various functions, for example, noise filtering, A/D conversion, encoding/decoding and modulating.

According to the exemplary embodiments of the disclosure, the free space of the loop antenna may be secured by implementing the integrated glass antenna, and an additional antenna module may be installed in the free space of the loop antenna. Therefore, it is possible to install more antenna modules in the same space and further improve the isolation between the antenna modules.

The disclosed embodiments is merely illustrative of the technical idea, and those skilled in the art will appreciate that various modifications, changes, and substitutions may be made without departing from the essential characteristics thereof. Therefore, the exemplary embodiments disclosed above and the accompanying drawings are not intended to limit the technical idea, but to describe the technical spirit, and the scope of the technical idea is not limited by the embodiments and the accompanying drawings. The scope of protection shall be interpreted by the following claims, and all technical ideas within the scope of equivalent shall be interpreted as being included in the scope of rights.

What is claimed is:

1. An antenna system of a vehicle comprising:

a glass antenna disposed on a surface of a glass of the vehicle and configured to receive a first broadcast signal and a second broadcast signal; and a broadcasting receiver configured to receive the first broadcast signal and the second broadcast signal transmitted from the glass antenna, to extract a harmonic component of the first broadcast signal, to invert a phase of the extracted harmonic component, and to cancel and remove a harmonic component identical to the harmonic component included in the second broadcast signal by adding the phase-inverted harmonic component to the second broadcast signal.

2. The antenna system of the vehicle according to claim 1, wherein the first broadcast signal is a radio broadcast signal, wherein the second broadcast signal is a digital broadcast signal, and wherein the harmonic component of the first broadcast signal is an FM harmonic component of the radio broadcast signal.

3. The antenna system of the vehicle according to claim 1, wherein the glass antenna comprises:

a first glass antenna configured to receive signals of some channels of the first broadcast signal and some channels of the second broadcast signal; and a second glass antenna configured to receive signals of remaining channels of the first broadcast signal and remaining channels of the second broadcast signal.

4. The antenna system of the vehicle according to claim 3, wherein the received signals of the first glass antenna comprise an AM signal, a first FM signal, and a first DMB signal, and wherein the received signals of the second glass antenna comprise a second FM signal and a second DMB signal.

5. An antenna system of a vehicle comprising:

a glass antenna disposed on a surface of a glass of the vehicle and configured to receive a first broadcast signal and a second broadcast signal; and a broadcasting receiver configured to:

receive the first broadcast signal and the second broadcast signal transmitted from the glass antenna, extract a harmonic component of the first broadcast signal from a transmission path of the first broadcast signal, invert the extracted harmonic component, and cancel and remove a harmonic component, identical to the extracted harmonic component of the first broadcast signal, from the second broadcast signal by adding a phase-inverted harmonic component to a transmission path of the second broadcast signal.

6. The antenna system of the vehicle according to claim 5, wherein the first broadcast signal is a radio broadcast signal, wherein the second broadcast signal is a digital broadcast signal, and wherein the harmonic component of the first broadcast signal is an FM harmonic component of the radio broadcast signal.

7. The antenna system of the vehicle according to claim 5, wherein the glass antenna comprises:

a first glass antenna configured to receive signals of some channels of the first broadcast signal and some channels of the second broadcast signal; and a second glass antenna configured to receive signals of remaining channels of the first broadcast signal and remaining channels of the second broadcast signal.

8. The antenna system of the vehicle according to claim 7, wherein the received signals of the first glass antenna comprise an AM signal, a first FM signal, and a first DMB signal, and wherein the received signals of the second glass antenna comprise a second FM signal and a second DMB signal.

9. The antenna system of the vehicle according to claim 5, wherein the transmission path of the first broadcast signal comprises a first preprocessor configured to preprocess the first broadcast signal, and wherein the transmission path of the second broadcast signal comprises a second preprocessor configured to preprocess the second broadcast signal.

10. The antenna system of the vehicle according to claim 9, wherein the broadcasting receiver further comprises:

a band pass filter configured to extract a harmonic component from an output signal of the first preprocessor;

a phase inverter configured to invert a phase of the harmonic component extracted by the band pass filter; and an adder configured to add the harmonic component of which the phase is inverted to the second broadcast signal input to the second preprocessor.

11. An antenna system of a vehicle comprising:

a glass antenna disposed on a surface of a glass of the vehicle and configured to receive a first broadcast signal and a second broadcast signal; and a broadcasting receiver configured to:

receive the first broadcast signal and the second broadcast signal transmitted from the glass antenna;

perform a preprocessing of each of the first broadcast signal or the second broadcast signal through a single wideband signal preprocessor; and when receiving the second broadcast signal, extract a harmonic component of the first broadcast signal, invert a phase of the extracted harmonic component, and cancel and remove a harmonic component identical to the harmonic component of the first broadcast signal from the second broadcast signal by adding the phase-inverted harmonic component to a transmission path of the second broadcast signal.

12. The antenna system of the vehicle according to claim 11, wherein the first broadcast signal is a radio broadcast signal, wherein the second broadcast signal is a digital broadcast signal, and wherein the harmonic component of the first broadcast signal is an FM harmonic component of the radio broadcast signal.

13. The antenna system of the vehicle according to claim 11, wherein the glass antenna comprises:

a first glass antenna configured to receive signals of some channels of the first broadcast signal and some channels of the second broadcast signal; and a second glass antenna configured to receive signals of remaining channels of the first broadcast signal and remaining channels of the second broadcast signal.

14. The antenna system of the vehicle according to claim 13, wherein the received signals of the first glass antenna comprise an AM signal, a first FM signal, and a first DMB signal, and wherein the received signals of the second glass antenna comprise a second FM signal and a second DMB signal.

15. The antenna system of the vehicle according to claim 14, wherein the broadcasting receiver further comprises:

a channel selector configured to selectively receive one of the first broadcast signal and the second broadcast signal in response to a channel selection by a user; and a tunable filter configured to selectively pass the broadcast signal of a channel selected by the user among the first broadcast signal and the second broadcast signal output from the wideband signal preprocessor.

16. The antenna system of the vehicle according to claim 15, wherein the broadcast signal is selected from the glass antenna, the channel selector, the wideband signal preprocessor, and the tunable filter according to a control command generated by the channel selection by the user.

17. The antenna system of the vehicle according to claim 16, wherein the channel selection by the user is performed through an operation of a head unit connected to the antenna system of the vehicle.

* * * * *